US012419490B2

(12) United States Patent
Nesmeyanov

(10) Patent No.: US 12,419,490 B2
(45) Date of Patent: Sep. 23, 2025

(54) FASTENERS FOR WASHING FOOTWEAR IN A WASHING MACHINE

(71) Applicant: Aleksej Vladimirovich Nesmeyanov, Dusseldorf (DE)

(72) Inventor: Aleksej Vladimirovich Nesmeyanov, Dusseldorf (DE)

( * ) Notice: Subject to any disclaimer, the term of this patent is extended or adjusted under 35 U.S.C. 154(b) by 528 days.

(21) Appl. No.: 17/919,272

(22) PCT Filed: Jun. 24, 2021

(86) PCT No.: PCT/RU2021/000266
§ 371 (c)(1),
(2) Date: Oct. 16, 2022

(87) PCT Pub. No.: WO2022/005327
PCT Pub. Date: Jan. 6, 2022

(65) Prior Publication Data

US 2023/0148833 A1 May 18, 2023

(30) Foreign Application Priority Data

Jun. 29, 2020 (RU) ..... RU2020121516

(51) Int. Cl.
*A47L 23/18* (2006.01)
*D06F 39/00* (2024.01)
*D06F 95/00* (2006.01)

(52) U.S. Cl.
CPC ..... *A47L 23/18* (2013.01); *D06F 39/00* (2013.01); *D06F 95/008* (2013.01)

(58) Field of Classification Search
None
See application file for complete search history.

(56) References Cited

U.S. PATENT DOCUMENTS

| | | | |
|---|---|---|---|
| 5,398,428 | A | 3/1995 | Wallace |
| 5,974,693 | A | 11/1999 | Richards et al. |
| 2003/0084585 | A1 | 5/2003 | Tomasi et al. |
| 2012/0031152 | A1 | 2/2012 | Conti |

FOREIGN PATENT DOCUMENTS

| | | | |
|---|---|---|---|
| CN | 102108615 | B | 6/2015 |
| CN | 102108616 | B | 9/2015 |
| CN | 110226910 | A | 9/2019 |
| DE | 102018010302 | A1 | 12/2019 |
| KR | 980008200 | U | 4/1998 |

OTHER PUBLICATIONS

Search Report in PCT/RU2021/000266, dated Nov. 3, 2021.

*Primary Examiner* — Levon J Shahinian
(74) *Attorney, Agent, or Firm* — Bardmesser Law Group

(57) ABSTRACT

A retainer for washing footwear, wherein fixing the footwear inside the washing machine drum by pressing the footwear against the drum inner surface with the footwear part opposite to the sole (toe, vamp, tongue, flap, lacing, quarter, soft edging, heel), for this the footwear are oriented in the drum with the soles to the drum center, and the upper part to the drum inner surface, while the locking jaws of the sliding clamping rail are attached to the footwear at the sole side.

18 Claims, 16 Drawing Sheets

FASTENERS FOR WASHING FOOTWEAR IN A WASHING MACHINE

BACKGROUND OF THE INVENTION

Field of the Invention

The invention relates to the field of footwear cleaning, specifically to devices for fixing position of sports footwear inside a washing machine drum and preventing its uncontrolled movement during washing, as well as during drying and wringing.

The invention can be used for personal or commercial purposes.

Background of the Related Art

Retainers for washing sports footwear in a washing machine are known, as described in U.S. Pat. Nos. 5,398,428 and 5,974,693, which are made in the form of sliding spring-loaded rail spacers installed inside the drum of the washing machine.

US 20030084585 describes a solution made in the form of a sliding pressure rail installed inside the drum of a washing machine and pressing the footwear sole to the drum inner surface.

A disadvantage of these known solutions is difficulty of drying and wringing footwear at high drum speed due to centrifugal retention of washing liquid inside the footwear.

The purpose of this intention is to eliminate the shortcomings of known solutions.

SUMMARY OF THE INVENTION

The purpose of the solution claimed is achieved by fixing the footwear inside the washing machine drum by pressing the footwear against the drum inner surface with the footwear part opposite to the sole (toe, vamp, tongue, flap, lacing, quarter, soft edging, heel), for this the footwear are oriented in the drum with the soles to the drum center, and the upper part to the drum inner surface, while the locking jaws of the sliding clamping rail are attached to the footwear at the sole side.

BRIEF DESCRIPTION OF THE ATTACHED DRAWINGS

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention.

DETAILED DESCRIPTION OF EMBODIMENTS OF THE INVENTION

Reference will now be made in detail to the preferred embodiments of the present invention, examples of which are illustrated in the accompanying drawings.

The claimed invention can have the following embodiments.

Figure 1:
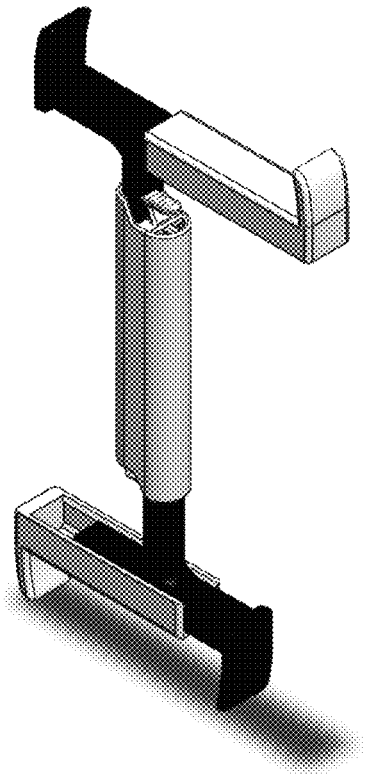
FIG. 1 shows a general view of the retainer (design variant for fastening one pair of footwear)
Figure 2:
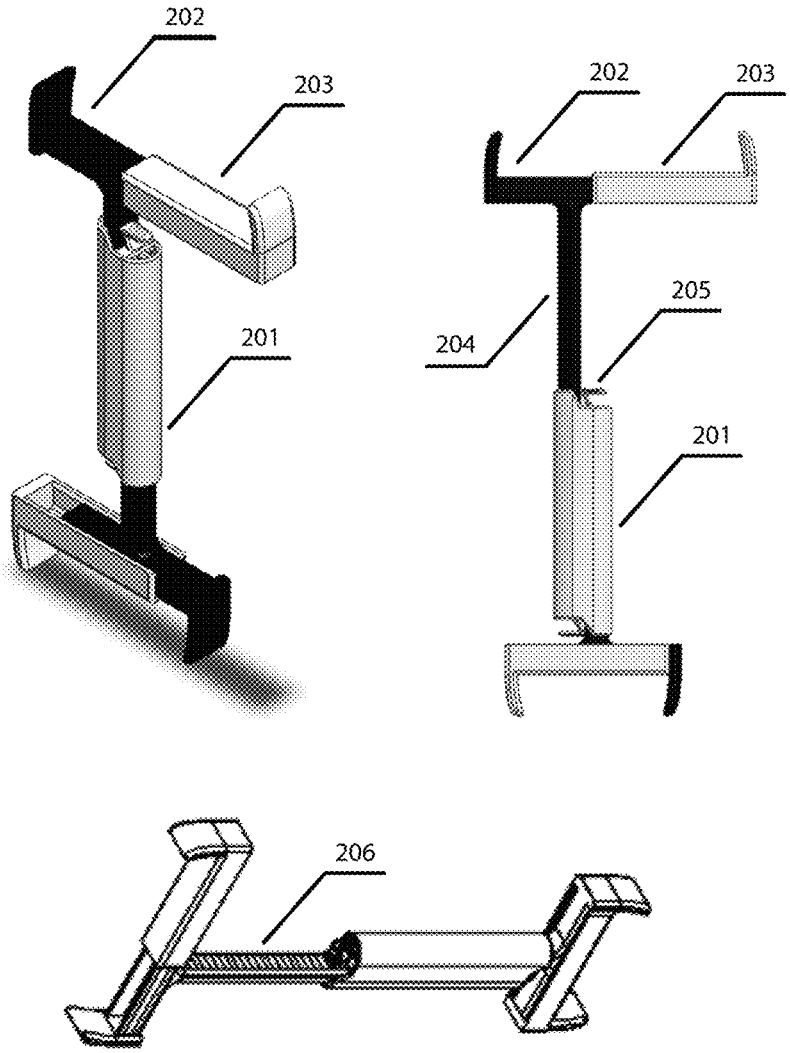
FIG. 2 shows the retainer.
Figure 3:
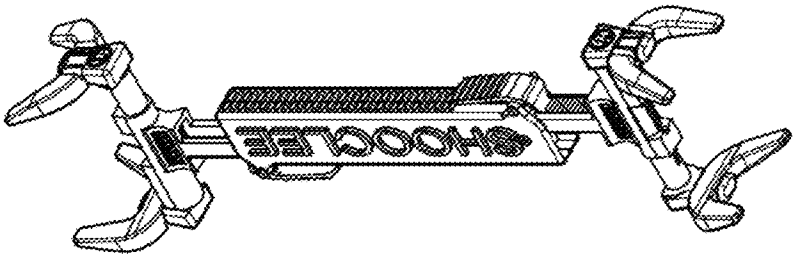
FIG. 3, FIG. 4, FIG. 5 and FIG. 6 show a general view of the retainer (design variant in which the jaws holding the sole are equipped with U/V shaped holders)
Figure 4:
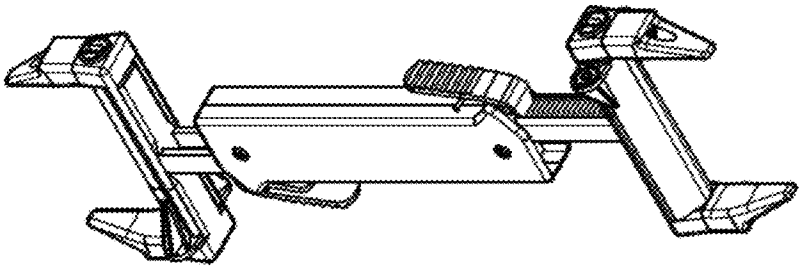
Figure 5:
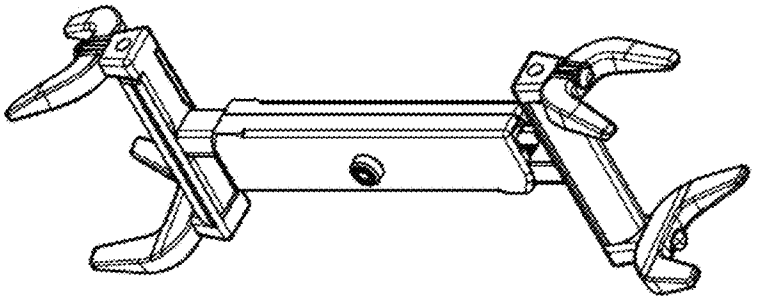
Figure 6:
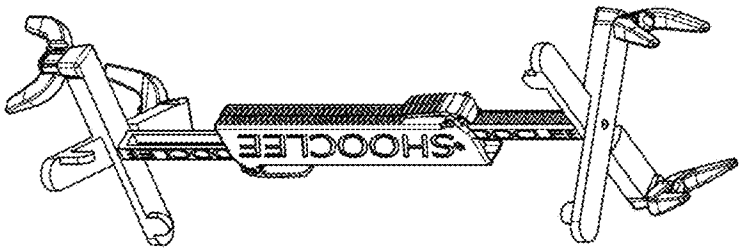
Figure 7:
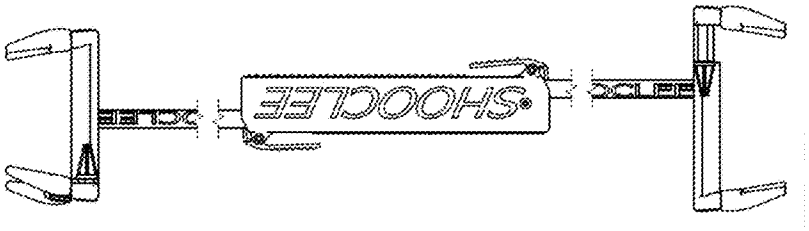
FIG. 7 shows the retainer (design variant where the jaws holding the sole have a mutually conjugated (nut-screw type) thread, a larger jaw in diameter contains a smaller one inside, it is equipped with a wing nut, while the jaws opening and closing occurs by means of mutual turning of the said threaded connection)
Figure 8:
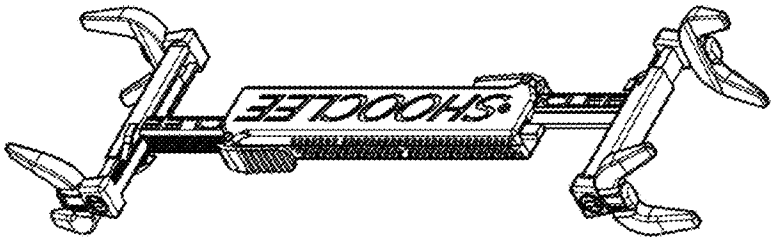
FIG. 8 shows the retainer (design variant where the jaws holding the sole are made in X-form (scissors) arranged so that rotation relative to the rail axis (scissors axis) is possible)
Figure 9:
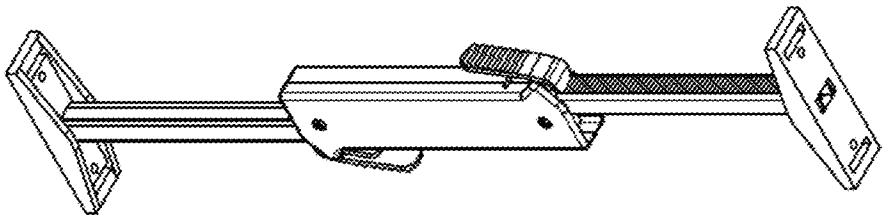
FIG. 9 shows the retainer (design variant where the T-shaped spacer-holders are provided with holes for threading into them textile fasteners, Velcro, or laces)
Figure 10:
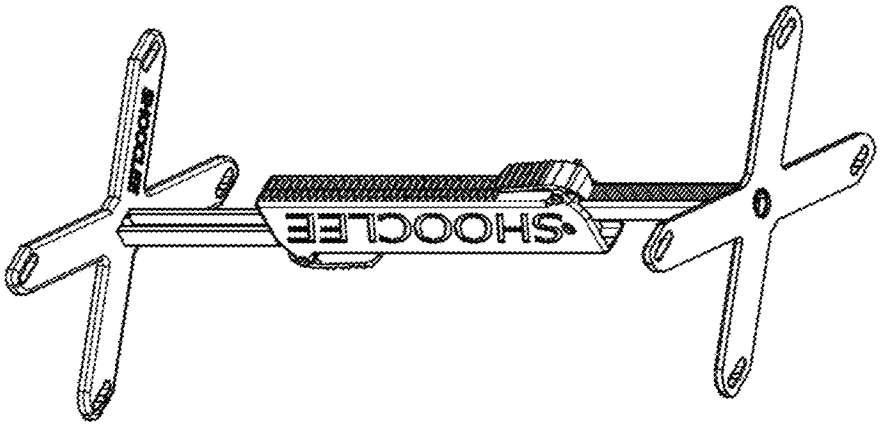
FIG. 10 shows a retainer for one pair of footwear (design variant where X-shaped spacer-holders are provided with holes for threading into them textile fasteners, Velcro, or laces)
Figure 11:
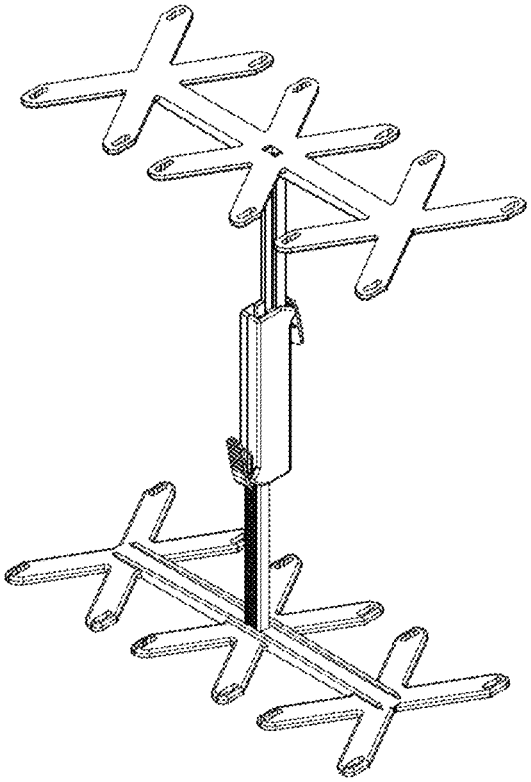
FIG. 11 shows the retainer for three pairs of footwear (design variant where X-shaped spacer-holders are provided with holes for threading into them textile fasteners, Velcro, or laces)
Figure 12:
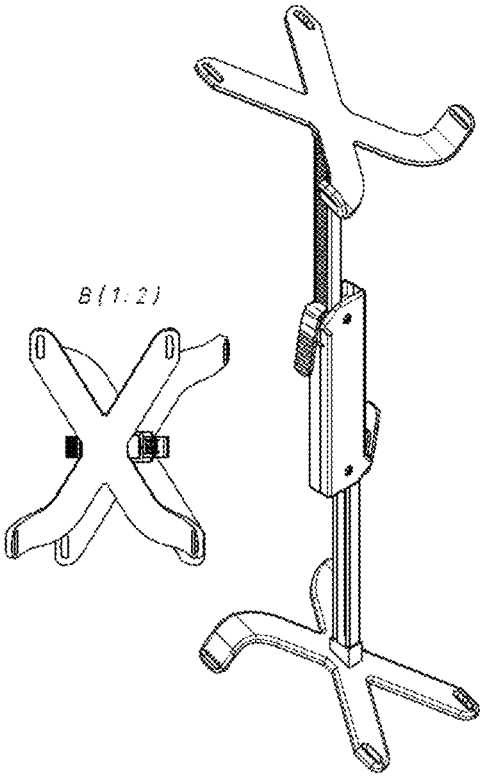
FIG. 12 shows the retainer (design variant where the footwear holders at the ends of the rails are made in the form of an X-shaped structure located at an angle to the spacer axis (or rotatable) for more precise clamping of the footwear toe and tops)
Figure 13:
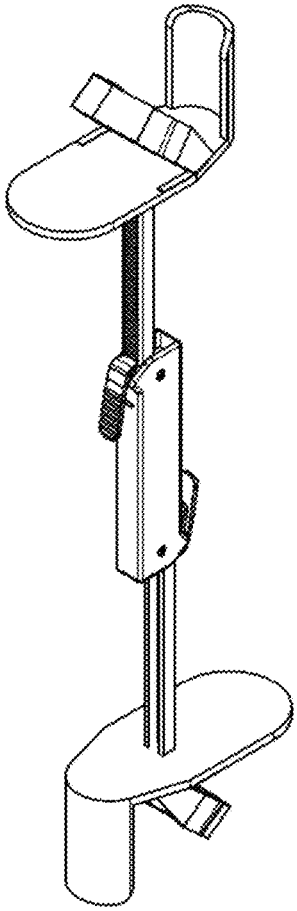
FIG. 13 shows the retainer for one pair of footwear (design variant where the spacer-holder is made in the form of a rigid platform equipped with latches and retractable heel-back)
Figure 14:
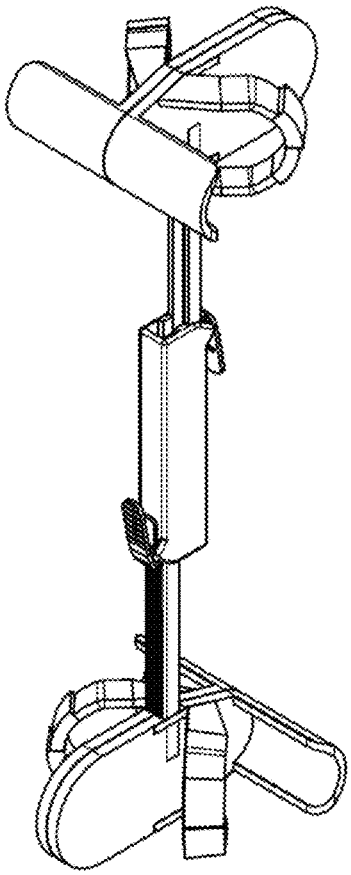
FIG. 14 shows the retainer for two pairs of footwear (design variant where the spacer-holder is made in the form of a rigid platform equipped with latches and a retractable heel-back)
Figure 15:
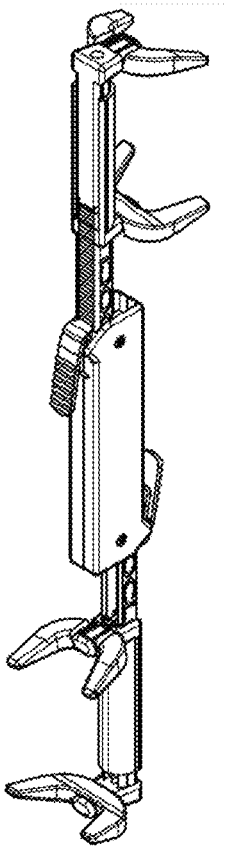
FIG. 15 and FIG. 16 shows the retainer (design variant where the spacer-holder is made in the form of two vertically positioned and vertically moving clips fixing the footwear by the sole in a vertical plane, so that the footwear is pressed against the drum not by the top of the footwear, but by the side)
Figure 16:
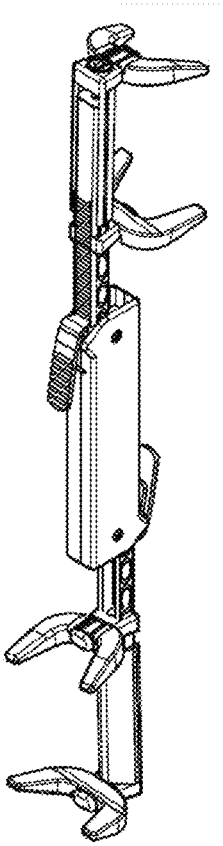
Figure 17:
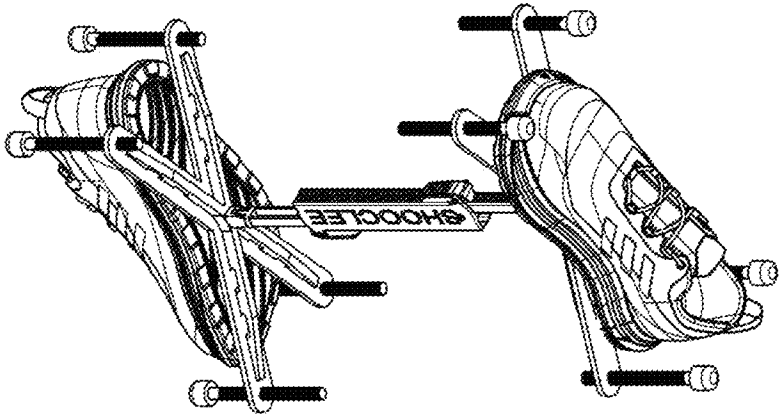
FIG. 17 shows the retainer (design variant where the spacer-holder at the end is made in the form of a strong flat plate-frame with holes at the corners made for screwing in protective pins capable of changing screwing height)
Figure 18:
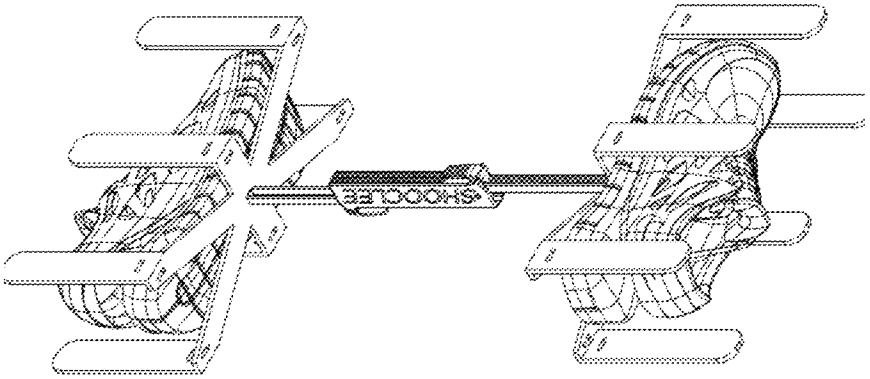
FIG. 18 shows the retainer (design variant where the spacer-holder at the end is made in the form of a strong protective frame)
Figure 19:
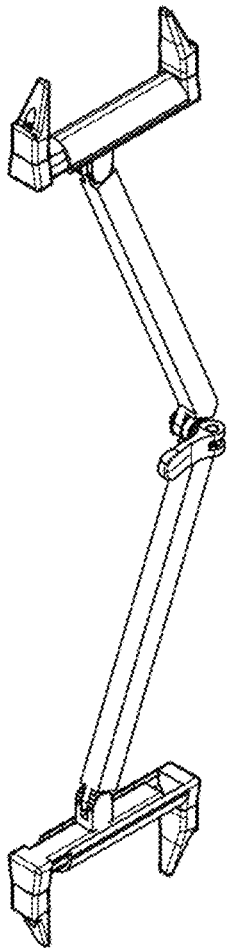
FIG. 19, FIG. 20, FIG. 21 and FIG. 22 shows the variants of the retainer where the sliding part is made in the form of a single-fold hinged frame (V-type) equipped with a lock that fixes the desired opening angle.
Figure 20:
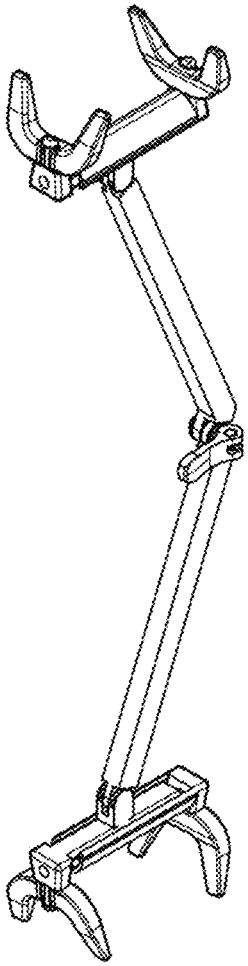
Figure 21:
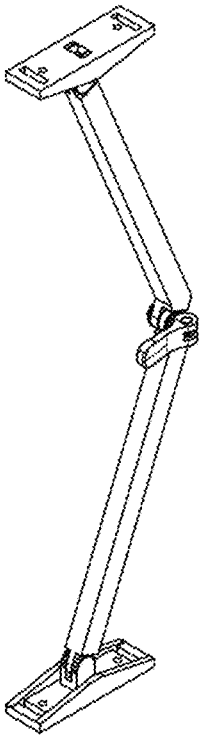
Figure 22:
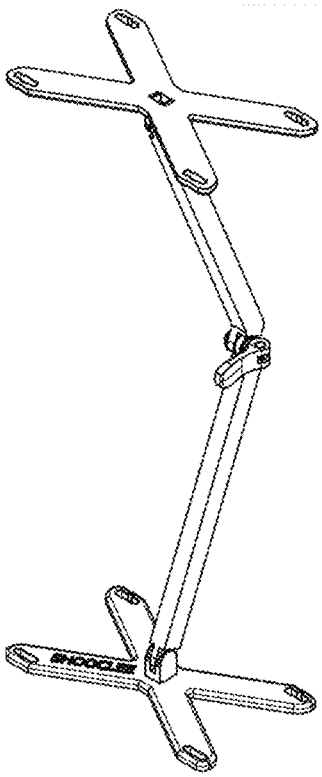
Figure 23:
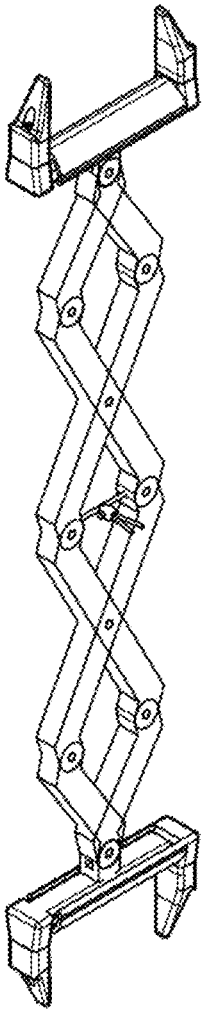
FIG. 23, FIG. 24, FIG. 25, FIG. 26 and FIG. 27 shows the variants of the retainer where the middle sliding part is made in the form of an accordion hinge equipped with a lock that fixes the desired opening angle.
Figure 24:
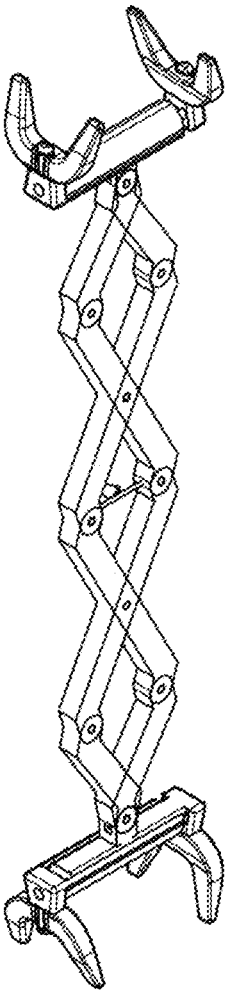
Figure 25:
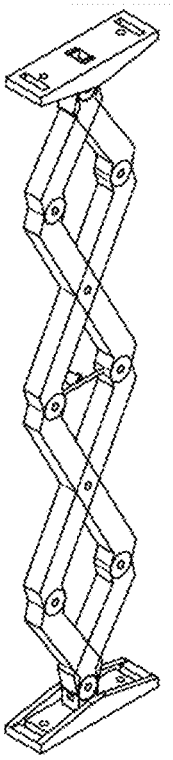
Figure 26:
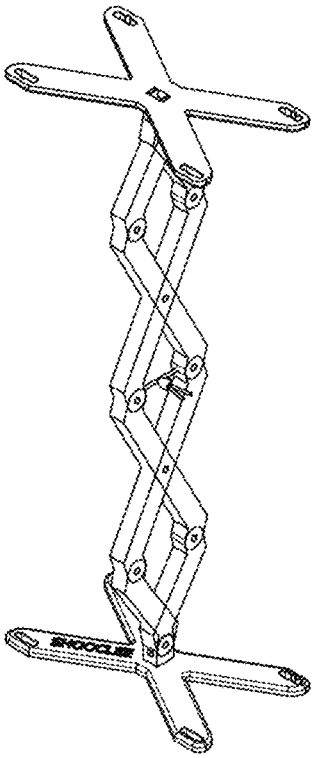
Figure 27:
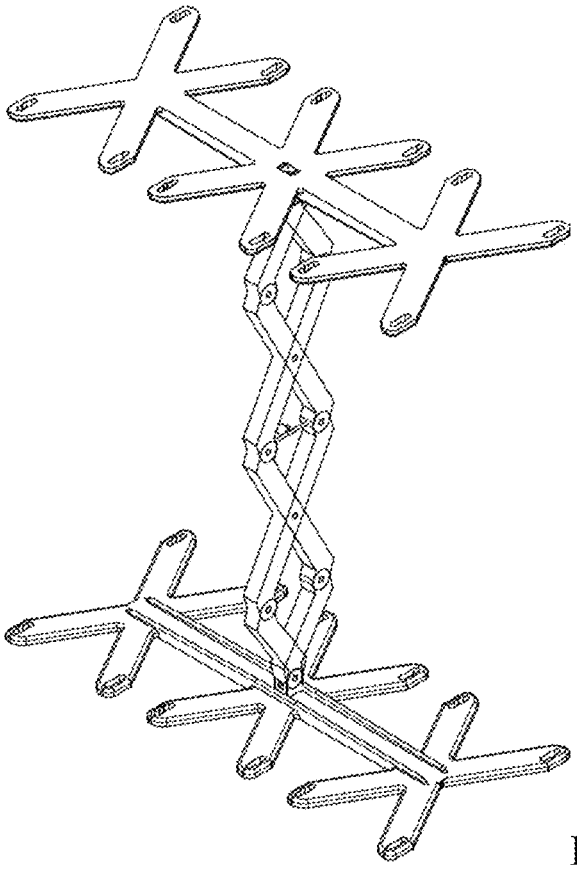
Figure 28:
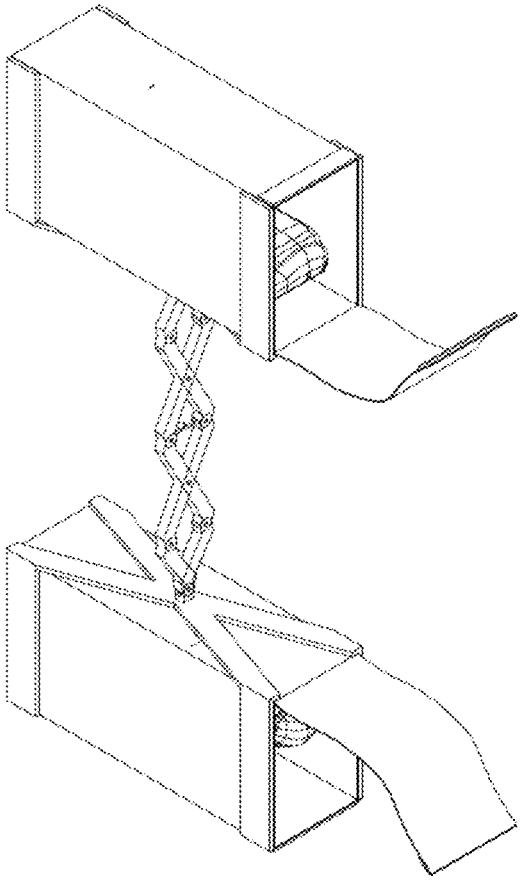
FIG. 28 shows the retainer (design variant where the spacer-holder at the end is made in the form of a box made of textile mesh with stiffening ribs to rest in the drum of the washing machine)
Figure 29:
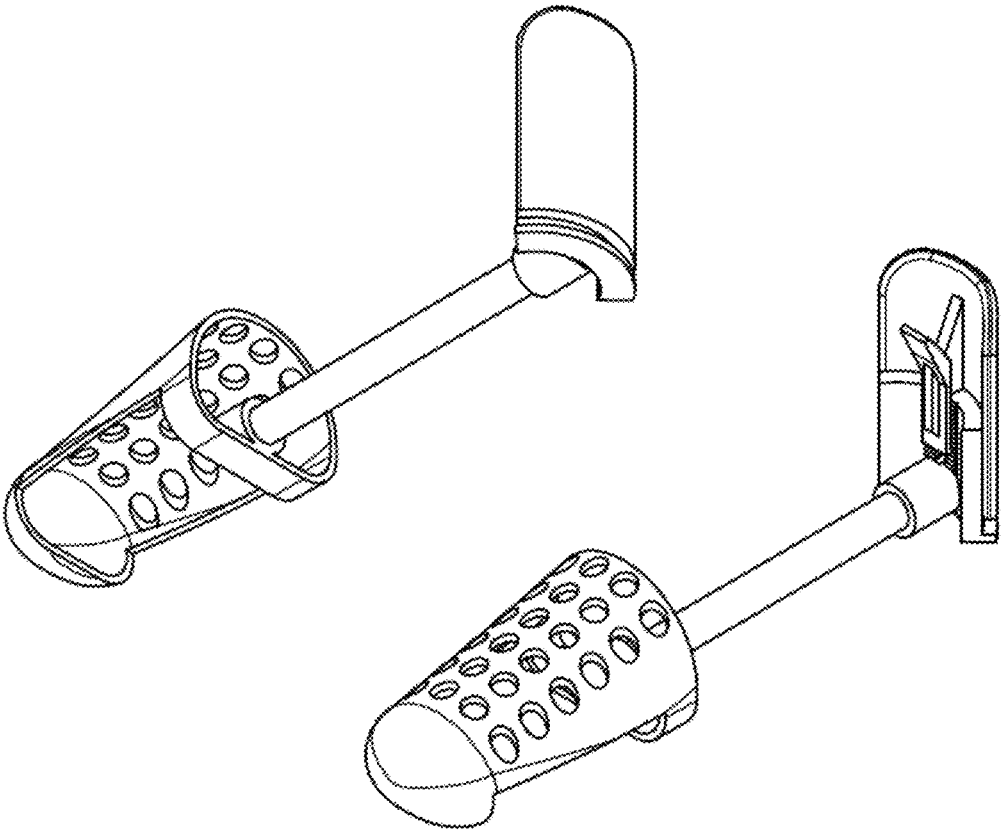
FIG. 29 shows a protective perforated pad with a sliding back inserted into the footwear before fixing it in the retainer.

FIG. 2 shows the retainer where:

retainer housing;

T-shaped spacer-holder;

movable jaw of spacer-holder;

spacer-holder rail;

205—retaining latch of the rail;

206—comb of the retaining latch

When folded (for storage or transportation), the T-shaped spacer-holders (202, see figures) are recessed (placed inside) into the retainer body (201), and the movable jaws of the spacer-holders (203) are located at a minimum distance from the spacer rails (204).

The movable jaws of the spacers-holders (203) are opened to a width which allows fixing the footwear soles, the soles of are pressed against the upper parts of the T-shaped spacers-holders (202), the soles are fixed with movable jaws (203), the retainer with fixed footwear is placed in the drum of the washing machine, the retaining latches are released (205), the rails of the T-shaped spacers-holders (202) are drawn out of the retainer body (201) until the upper parts of the footwear fit tightly to the opposite sole (toe, vamp, tongue, flap, lacing, quarter, soft edging, heel), to the inner surface of the drum, while the soles of the footwear are oriented to the center of the drum.

Protrusions and grooves of the comb (206) (if available) in the form of wedge-shaped figures can provide closing and latching of retaining latches (205) on each ledge independently, due to elasticity of the structure.

After washing and wringing are completed, the retaining latches (205) are released, the rails of the T-shaped spacers-holders (202) are pushed into the retainer body (201) until it is possible to remove the retainer with fixed footwear from the washing machine drum, the spacer-holder movable jaws (203) are opened to a width which allows the footwear soles to be released.

Additionally, the latch comb of the spacer-retainer can be made in the same design and of the material as T-shaped spacer-holder, as part of it.

Additionally, the latch lock can be made in the same design and of the same material as the latch housing, as part of it, and it then will work due to the construction material elasticity.

Additionally, the retainer housing can be made centrally symmetrical, while T-shaped spacer-holders can move inside it, and be located in it, while the walls of the retainer housing can function as guide profiles (surfaces) defining movement direction.

Additionally, the retainer housing can be equipped with a device to ensure symmetry of the spacer movement, for example, a sprocket gear engaged with the protrusions and grooves of the spacer combs.

Each of the device elements can be made in various ways, using various designs (spring-loaded multi-section, sliding, etc.), and of various materials.

The claimed invention makes it possible to effectively remove washing liquid from the inner volume of footwear during drying and wringing.

DETAILED SPECIFICATION

The retainer for washing footwear in a washing machine has a housing equipped with a retaining latch-lock, T-shaped spacer holders equipped with movable jaws and located on rails having combs of grooves-protrusions, while folded (for storage or transportation), T-shaped spacer-holders are recessed (placed inside) into the housing, and the movable jaws are located at a minimum distance from the spacer rails, and when the footwear retainer is located inside the washing machine drum, the footwear are tightly fixed with the sole in the spacer-holder jaws, the soles are oriented to the center of the drum, the upper part to the inner surface of the drum, they are tightly pressed against the inner surface of the drum by the part opposite to the sole (toe, vamp, tongue, flap, lacing, quarter, soft edging, heel), while tight clamping is provided by maximum possible drawing out of the spacers-holders from the body, and their reverse movement is blocked by engagement of the latch lock with the comb.

The retainer contains beams of arbitrary profile inserted into each other and held together by an elastic element (compression spring, tension spring and/or elastic band with appropriate fasteners for these elastic elements).

The retainer has the jaws holding the sole are provided with pads made of a soft material, which prevents damage to the footwear and prevents it from falling out of the retainer.

The retainer housing can be equipped with a device to ensure symmetry of the opening the spacers, for example, due to a sprocket gear engaged with the protrusions and grooves of the combs, and equipped with a ratchet mechanism to prevent slippage and a common reset button of the ratchet mechanism.

The jaws holding the sole are equipped with U/V-shaped holders fixed so that rotation around a vertical axis is possible, capable of more sensibly and accurately follow the sole geometry at the point of contact.

The jaws holding the sole have a mutually conjugated (nut-screw type) thread, a larger jaw in diameter contains a smaller one inside, it is equipped with a wing nut, while the jaws opening and closing occurs by means of mutual turning of the said threaded connection.

Each of the jaws is provided with a thread with opposite thread direction, both jaws with their threaded parts are located in one common wing nut, while the jaw opening symmetry is ensured by rotation of this wing nut.

The jaws holding the sole are made X-shaped (scissors) arranged so that rotation relative to the rail axis (scissors axis) is possible, equipped with a common torsion spring which tends to bring the ends of the jaws (sharp ends of the scissors) together, while opening the jaw latch, when placing and removing footwear, is carried out by bringing together the holes for the scissor fingers.

The T-shaped spacer-holders do not have protruding retaining jaws, but are equipped with holes for threading into them textile fasteners, Velcro, or laces (in any configuration) which fix the footwear upper part.

The footwear holders at the ends of the rails are made in the form of an X-shaped structure located at an angle to the spacer axis (or rotatable) for more precise clamping of the footwear toe and tops.

The spacer-holder is made in the form of a rigid platform equipped with latches and a retractable heel-back protecting the back of the footwear from deformation, both with contact and with a stop in the drum, and without such a stop.

The spacer-holder is made in the form of a double rigid platform for fastening two pairs of footwear, equipped with latches and a heel-back, so that the footwear is pressed not by the top of the footwear, but by the side.

The spacer-holder is made in the form of two vertically positioned and vertically moving clips fixing the footwear by the sole in a vertical plane, so that the footwear is pressed against the drum not by the top of the footwear, but by the side).

The movable spring-loaded jaw is the outer part of the spacer-holder and directly rests against the drum and reduces the pressure on the footwear.

The external movable spring-loaded jaw does not have a rigid connection with the rail, and presses the footwear against the drum by means of additional rotation of the drum.

The spacer-holder at the end is made in the form of a box made of textile mesh with stiffening ribs to rest in the drum of the washing machine and the mesh is rigidly fastened with spacers.

The spacer-holder at the end is made in the form of a strong protective frame to which the footwear is pressed with the sole, resting against the drum and protecting the footwear.

The spacer-holder at the end is made in the form of a strong flat plate-frame at the corners of which holes are made for screwing in protective pins capable of changing the height of screwing, soft or hard stops can be available at the ends of the pins for better contact with the washing machine drum.

The sliding part is made in the form of a single-fold hinged frame (V-type) equipped with a lock that fixes the desired opening angle.

The sliding jaws can be available at the ends of the sliding part, holes for laces and Velcro, textile boxes, and protective frames.

The the middle sliding part is made in the form of an accordion hinge equipped with a lock that fixes the desired opening angle.

The sliding jaws can be available at the ends of the sliding part, holes for laces and Velcro, textile boxes, and protective frames.

The protective perforated pad with a sliding back to insert into the footwear before fixing it in the retainer, suitable for pressing the footwear against the washing machine drum both with top and with side, for larger clamping force can be additionally equipped with a magnet.

A method of using the footwear retainer for washing footwear in a washing machine, where the movable jaws of the spacer-holders are opened to a width which allows the soles of footwear to be fixed, the soles of footwear are pressed against the upper parts of the T-shaped spacer-holders, the soles of footwear are fixed with movable jaws, the retainer with fixed footwear is placed in the washing machine drum, the fixing latch locks are released, the rails of T-shaped spacer-holders are drawn out of the retainer body until the upper parts of the footwear fit tightly to the opposite sole (toe, vamp, tongue, flap, lacing, quarter, soft edging, heel), to the inner surface of the drum, while the soles of the footwear are oriented to the drum center, and after end of washing and wringing, the latch locks are released, the latches of the T-shaped spacer-holders are retracted into the retainer body until it is possible to remove the retainer with fixed footwear from the drum of the washing machine, the movable jaws of the spacer-holders are opened to a width which allows releasing the soles of footwear.

A method where the insertion of the sole into the movable spring-loaded jaw stop is began from the spring-loaded edge, the sole edge is inserted and this spring-loaded stop is pushed by the sole itself until the distance between the jaws is sufficient to insert the entire sole, then the entire sole is lowered into the gap formed.

Having thus described a preferred embodiment, it should be apparent to those skilled in the art that certain advantages of the described method and apparatus have been achieved.

It should also be appreciated that various modifications, adaptations and alternative embodiments thereof may be made within the scope and spirit of the present invention. The invention is further defined by the following claims.

What is claimed is:

1. A retainer for washing footwear in a washing machine, comprising:

a housing including a retaining latch-lock, and T-shaped spacer-holders with movable jaws and located on rails with each movable jaw having a comb of protrusions spaced by grooves, while folded for storage or transportation, wherein the T-shaped spacer-holders are recessed in the housing, and wherein the movable jaws are located at a distance from the rails, and wherein, when the retainer is located inside a washing machine drum, the footwear are tightly fixed with soles of the footwear in the movable jaws, such that the soles are oriented to a center of the washing machine drum, with upper part of the soles oriented to an inner surface of the washing machine drum, wherein the soles are tightly pressed against the inner surface of the washing machine drum by a part of the footwear opposite to the soles, the part of the footwear being any of toe, vamp, tongue, flap, lacing, quarter, soft edging, and heel, wherein tight clamping is provided by maximum possible drawing out of the spacer-holders from the retainer, and reverse movement of the spacer-holders is blocked by engagement of the latch-lock with the combs, wherein the retainer housing includes a sprocket gear to ensure symmetry of the spacer-holders upon opening, wherein the sprocket gear engages the protrusions and the grooves, and wherein the sprocket gear includes a ratchet mechanism to prevent slippage and a common reset button of the ratchet mechanism.

2. The retainer of claim 1, further comprising beams inserted into each other and held together by an elastic element, the elastic element being any of a compression spring, a tension spring and an elastic band with fasteners.

3. The retainer of claim 1, wherein the movable jaws include pads made of a soft material for preventing the footwear from falling out of the retainer.

4. The retainer of claim 1, wherein the movable jaws include U- or V-shaped holders fixed to enable rotation of the soles around a vertical axis.

5. The retainer of claim 1, wherein each of the movable jaws includes a thread with opposite thread direction, wherein both movable jaws with their threaded parts are located in one common wing nut, while a symmetry of jaw opening is ensured by rotation of the one common wing nut.

6. The retainer of claim 1, wherein the movable jaws are X-shaped in a shape of scissors and arranged so that rotation relative to a rail axis is possible, wherein the movable jaws have a common torsion spring that brings ends of the movable jaws together, while opening a jaw latch, and wherein placing and removing the footwear occurs by bringing together holes of scissor handles.

7. The retainer of claim 1, wherein the T-shaped spacer-holders have holes for threading textile fasteners, Velcro, or laces that fix the footwear.

8. The retainer of claim 1, wherein the footwear holders at ends of the rails have an X-shaped structure located at an angle to a spacer axis.

9. The retainer of claim 1, wherein each spacer-holder is a rigid platform equipped with latches and a retractable heel-back protecting the footwear from deformation.

10. The retainer of claim 1, wherein each spacer-holder is a double rigid platform for fastening two pairs of footwear, equipped with latches and a heel-back.

11. The retainer of claim 1, wherein each spacer-holder has two vertically positioned and vertically moving clips fixing the footwear by the soles in a vertical plane, so that the footwear is pressed against the washing machine drum.

12. The retainer of claim 11, wherein one of the movable jaws is spring-loaded and is an outer part of one of the spacer-holders and directly rests against the washing machine drum.

13. The retainer of claim 12, wherein the one of the movable jaws does not have a rigid connection with its corresponding rail, and presses the footwear against the washing machine drum by rotation of the drum.

14. The retainer of claim 1, wherein an end of the spacer-holder is a box made of textile mesh with stiffening ribs to rest in the washing machine drum, and the textile mesh is rigidly fastened with spacer-holders.

15. The retainer of claim 1, wherein each spacer-holder is made in the form of a strong protective frame to which the footwear is pressed with the sole, resting against the washing machine drum and protecting the footwear.

16. The retainer of claim 1, wherein each spacer-holder is made in the form of a strong flat plate-frame at corners of which holes are made for screwing in protective pins capable of changing a height of screwing, with stops at ends of the protective pins for contact with the washing machine drum.

17. The retainer of claim 1, wherein each of the movable jaws includes a sliding part that is made in a form of a single-fold hinged frame of a V-type with a lock that fixes a desired opening angle.

18. A retainer for washing footwear in a washing machine, comprising:

a housing including a retaining latch-lock, and T-shaped spacer-holders with movable jaws and located on rails with each movable jaw having a comb of protrusions spaced by grooves, while folded for storage or transportation, wherein the spacer-holders are recessed in the housing, and wherein the movable jaws are located at a distance from the rails, and wherein, when the retainer is located inside a washing machine drum, the footwear are tightly fixed with soles of the footwear in the movable jaws, such that the soles are oriented to a center of the washing machine drum, with upper part of the soles oriented to an inner surface of the washing machine drum, wherein the soles are tightly pressed against the inner surface of the washing machine drum by a part of the footwear opposite to the soles, the part of the footwear being any of toe, vamp, tongue, flap, lacing, quarter, soft edging and heel, wherein tight clamping is provided by maximum possible drawing out of the spacer-holders from the retainer, and reverse movement of the spacer-holders is blocked by engagement of the latch-lock with the combs, wherein the movable jaws holding the soles have a mutually conjugated thread of a nut-screw type, with a larger diameter jaw of the movable jaws containing a smaller movable jaw inside, the smaller movable jaw being equipped with a wing nut, while opening and closing of the movable jaws occurs by means of mutual turning of a connection of the mutually conjugated thread.

* * * * *